US005826358A

United States Patent [19]

DeSutter

[11] Patent Number: 5,826,358

[45] Date of Patent: Oct. 27, 1998

[54] DIRECTION-INDICATING SIGN HOLDER AND METHOD OF PROVIDING DIRECTIONAL INDICATION

[76] Inventor: Margaret J. DeSutter, 374 S. Elm Ave., St. Louis, Mo. 63119-3840

[21] Appl. No.: 248,307

[22] Filed: May 24, 1994

Related U.S. Application Data

[63] Continuation-in-part of Ser. No. 27,898, Mar. 8, 1993, abandoned.

[51] Int. Cl.[6] ..... G09F 7/02

[52] U.S. Cl. ..... 40/611; 40/661

[58] Field of Search ..... 40/612, 661, 611

[56] References Cited

U.S. PATENT DOCUMENTS

| | | | |
|---|---|---|---|
| 1,756,547 | 4/1930 | Hansen . | |
| 1,854,861 | 4/1932 | Reeves . | |
| 2,188,466 | 1/1940 | Willemain . | |
| 2,834,133 | 5/1958 | Carmack . | |
| 3,696,532 | 10/1972 | Nahon . | |
| 3,826,026 | 7/1974 | Bevan . | |
| 4,169,328 | 10/1979 | Frick, Jr. | 40/612 |
| 4,176,484 | 12/1979 | Terris | 40/612 X |
| 4,197,808 | 4/1980 | Kinninger | 40/612 X |
| 4,310,976 | 1/1982 | Wilten | 40/152.1 |
| 4,771,557 | 9/1988 | Bowman | 40/158.1 |

*Primary Examiner*—Joanne Silbermann
*Attorney, Agent, or Firm*—Howell & Haferkamp, L.C.

[57] ABSTRACT

A direction-indicating holder for an informational sign for use in directing people to a location associated with information on the sign. In one embodiment the holder includes top and bottom panels secured together to form a sign-receiving envelope between the panels. The holder has two converging side edges that indicate a direction, such that the holder can be oriented with the converging side edges indicating a direction toward a location associated with the information on a sign in the envelope. In another embodiment, the holder includes a flat, flexible panel the edge margins of the underside of the panel having an adhesive thereon for removably securing the panel over a sign onto a surface. According to the method of providing directional information of this invention, an informational sign is placed in a direction-indicating sign holder for indicating a direction associated with information on the sign. The holder is oriented so that the holder indicates a direction toward a location associated with information on the sign in the envelope.

18 Claims, 2 Drawing Sheets

DIRECTION-INDICATING SIGN HOLDER AND METHOD OF PROVIDING DIRECTIONAL INDICATION

CROSS-REFERENCE TO RELATED APPLICATION

This application is a continuation in part of U.S. patent application Ser. No. 08/027,898, filed Mar. 8, 1993, now abandoned.

BACKGROUND AND SUMMARY OF THE INVENTION

This invention relates to sign holders, and in particular to a holder for protecting and mounting a sign while providing directional information to a location associated with information on the sign.

Large buildings such as hotels, convention centers and schools often have directories where information can be displayed identifying the locations of particular events, but usually no provision is made for explaining to attendees how to get to the locations indicated. Sometimes signs will be posted directing attendees to a particular location, but these signs are often an after-thought. They are often hastily prepared and hand lettered. The signs are often haphazardly posted with tape, thumbtacks, or whatever is available. As a result, direction-indicating signs are usually not very attractive, professional looking or conspicuous.

The direction-indicating sign holder of the present invention provides a fast, easy and convenient way to mount an informational sign in an attractive, conspicuous, yet professional manner, while providing a clear directional message. The holder can be used to mount a pre-printed brochure or flyer for the event, or a specially prepared sign. Because the holder is conspicuous and provides the direction indicating message, a simple, type-written sign can be used, eliminating the necessity of crude, hand-written signs to attract attention.

Generally, the first embodiment of a direction-indicating sign holder of the present invention comprises top and bottom panels secured together to form a sign-receiving envelope between the panels. At least the top panel is transparent so that information on a sign in the envelope is visible. The envelope has an opening therein for introducing and removing a sign from the envelope. The holder has an overall shape with two converging side edges that indicate a direction, such that the holder can be oriented with the converging side edges indicating a direction toward a location associated with the information on a sign in the envelope. The holder preferably has a generally pentagonal shape, and each of the panels is an irregular pentagon, each having first and second elongate parallel sides with corresponding first and second ends; a third side connecting the first ends of the first and second sides; and converging third and fourth sides connecting the second ends of the first and second sides.

The holder may also include a direction-indicating graphic on one of the panels. This graphic preferably comprises a contrasting border having an outside edge corresponding to the shape of the holder, and an inside edge forming an arrow pointing in the same direction as the converging side edges of the holder.

Another embodiment of a direction-indicating sign holder constructed according to the principles of this invention comprises a flat, flexible panel. The edge margins of the underside of the panel having an adhesive thereon for removably securing the panel over a sign onto a surface. The adhesive is preferably a pressure sensitive adhesive, and has a removable protective backing for protecting the adhesive until the backing is removed to use the holder. The central portion of the panel is transparent so that information on a sign under the panel is visible therethrough. The panel is shaped with two converging side edges that indicate a direction, such that the holder can be oriented with the converging side edges indicating a direction toward a location associated with information on a sign under the holder.

The panel is preferably an irregular pentagon having first and second elongate parallel sides with corresponding first and second ends, a third side connecting the first ends of the first and second sides, and converging fourth and fifth sides connection the second ends of the fourth and fifth sides.

The holder may also include a direction-indicating graphic on the panel. The graphic preferably comprises a contrasting border having an outside edge corresponding to the shape of the panel, and an inside edge forming an arrow pointing in the same direction as the converging side edges of the panel.

The method of providing a directional indication to people, according to this invention comprises the steps of providing an informational sign; providing a direction-indicating sign holder; inserting the informational sign into the holder; and orienting the sign holder to indicate a direction toward a location associated with information on the sign in the holder.

The holder of the present invention is of simple and inexpensive construction. The holder makes the sign more visible while protecting the sign. The holder, when used according to the method of this invention, provides a clear directional signal, directing people toward a location associated with this sign.

BRIEF DESCRIPTION OF THE DRAWINGS

Corresponding reference numerals indicate corresponding parts throughout the several views of the drawings.

DETAILED DESCRIPTION OF THE PREFERRED EMBODIMENTS

Figure 1:
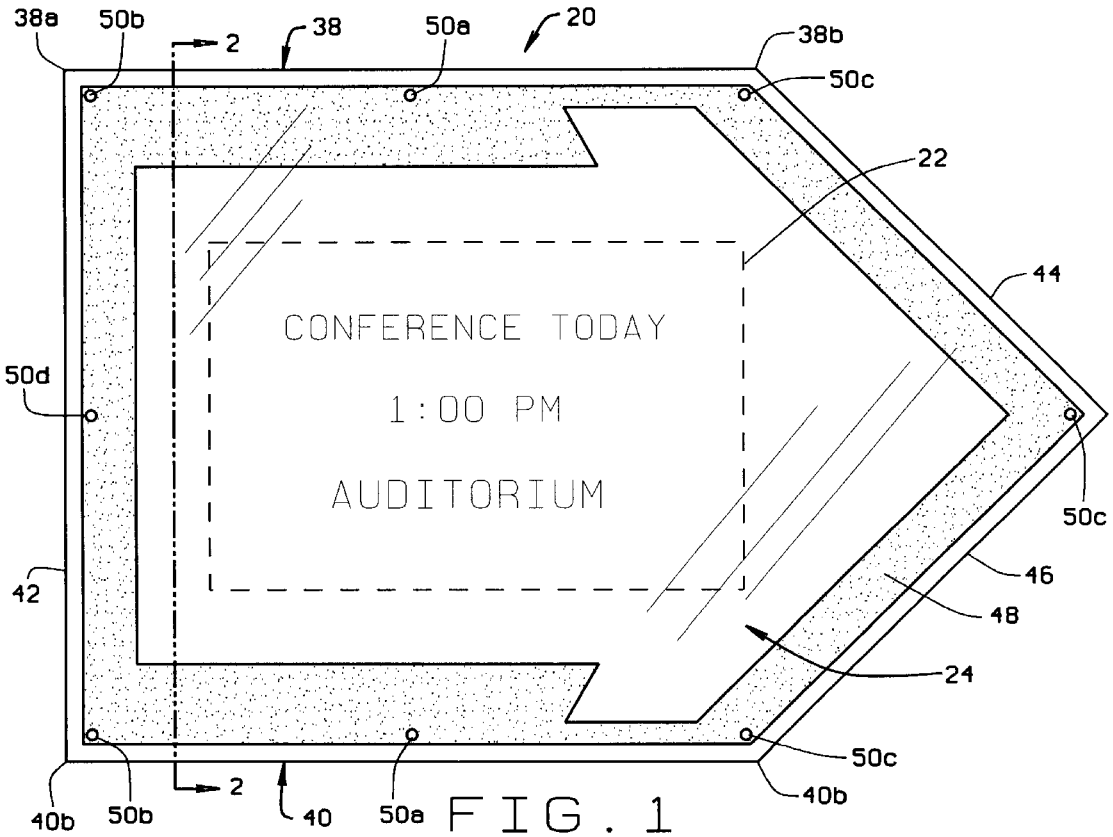
FIG. 1 is a top plan view of a first embodiment of a direction-indicating sign holder constructed according to the principles of this invention.
Figure 2:
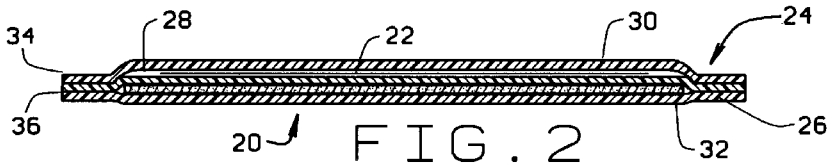
FIG. 2 is a transverse cross sectional view, taken along the plane of line 2—2 in FIG. 1, of the sign holder of the first embodiment.

A direction-indicating sign holder constructed according to the principles of this invention is indicated generally as 20 in FIGS. 1 and 2. The holder 20 is adapted to hold and protect an informational sign 22 while at the same time directing people to a location associated with information on the sign. The holder is preferably portable for temporary use. The informational sign is preferably a sheet of paper containing information about an event, such as a conference, a class, a performance, etc., being held at a specific time and place. Such a sign can be conveniently prepared on a computer system with a laser printer.

The holder 20 is generally flat, comprising a top panel 24 and a bottom panel 26 secured together to form a sign-receiving envelope 28 between the panels. The top panel 24 is preferably transparent, and may be a sheet 30 of transparent vinyl, or other suitable material. The bottom panel 26 is preferably comprises a relatively rigid sheet of cardboard 32, sandwiched between two sheets 34 and 36 of plastic, such as vinyl, secured together at their side edges with heat welding, adhesive, or other suitable means. The bottom panel 26 adds stiffness and rigidity to the holder 20. The top panel 24 and the bottom panel 26 are preferably secured together at their respective side edges by heat welding, adhesive, or other suitable means.

The envelope 28 has a opening therein so that a sign 22 can be placed into the envelope and removed from the envelope. The opening can comprise a gap between the top and bottom panels 24 and 26. Alternatively, the opening can comprise a slit in one of the panels.

The holder 20 is shaped to have two converging side edges that indicate a direction, such that the holder can be oriented with the converging side edges indicating a direction. In this preferred embodiment, the holder has the shape of an irregular pentagon comprising first and second elongate, parallel sides 38 and 40, having corresponding first and second ends 38*a* and 40*a*, and 38*b* and 40*b*, respectively. A third side 42, extending generally perpendicular to the first and second sides 38 and 40, connects the first ends 38*a* and 40*a* of the first and second sides. Converging third and fourth sides 44 and 46 connect the second ends 38*b* and 40*b* of the first and second sides 38 and 40. In this preferred embodiment, each of the top and bottom panels 24 and 26 have a similar irregular pentagonal shape corresponding to the shape of holder 20. The opening is formed by a gap between the top and bottom panels 24 and 26 along the third side 42.

The holder 20 may also include a direction-indicating graphic 48 on one of the panels. This graphic may be printed onto either the top surface of the top panel, or because the top panel is transparent it may also be printed on the underside surface of the top panel, or the top surface of the bottom panel. As shown in FIG. 1, the graphic 48 preferably comprises a contrasting border having an outside edge generally corresponding to the shape of the holder 20, in this preferred embodiment an irregular pentagon. The inside edge of the graphic 48 forms the outline of an arrow pointing in the same direction as the converging side edges of the holder 20. Thus the graphic 48 enhances the direction-indicating capability of the holder 20.

There are preferably a plurality of mounting holes 50 in the edge margins of the holder 20. Specifically, there are opposing holes 50*a*, generally in the centers of the first and second sides 38 and 40. The holes 50*a* are positioned with respect to the center of gravity of the holder such that when the holder is suspended by one of the holes 50*a*, the holder hangs generally horizontally, so that the converging side edges point generally horizontally. There are also opposing holes 50*b* generally adjacent the first ends 38*a* and 40*a* of the first and second sides. The holes 50*b* are positioned with respect to the center of gravity of the holder such that when the holder is suspended by one of the holes 50*b*, the holder slopes generally horizontally and downwardly so that the converging side edges point generally downwardly, for example, to indicate a direction down a staircase. There are also opposing holes 50*c* generally adjacent the second ends 38*b* and 40*b* of the first and second sides. The holes 50*c* are positioned with respect to the center of gravity of the holder such that when the holder is suspended by one of the holes 50*c*, the holder slopes generally upwardly so that the converging side edges point generally horizontally and upwardly, for example to indicate a direction up a staircase. There is also a hole 50*d* generally in the center of the third side 42. The hole 50*d* is positioned with respect to the center of gravity of the holder such that when the holder is suspended by the hole 50*d*, the holder points vertically downwardly, so that the converging side edges point vertically downwardly. Finally, there is a hole 50*e* generally at the convergence of the fourth and fifth sides 44 and 46. The hole 50*e* is positioned with respect to the center of gravity of the holder such that when the holder is suspended by the hole 50*e*, the holder points vertically upwardly, so that the converging side edges point vertically upwardly.

Figure 7:
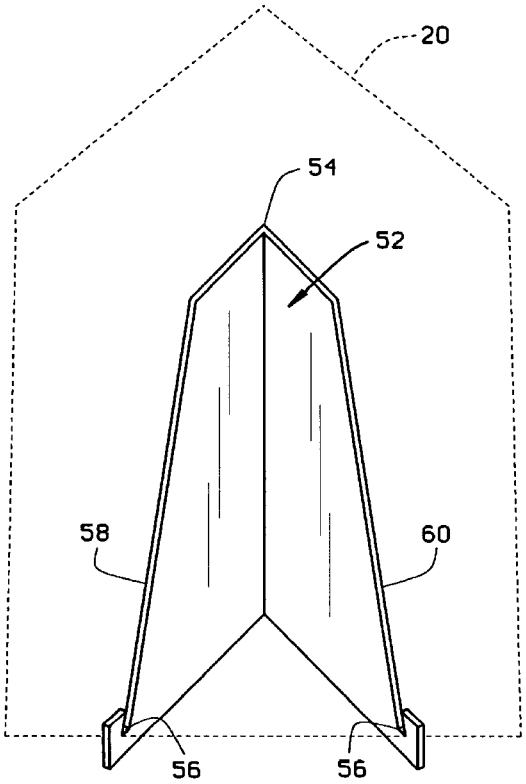
FIG. 7 is a front elevation view of the direction-indicating sign holder of the first embodiment shown on a collapsible easel.

As shown on FIG. 7, the sign holder 20 can also be mounted on a collapsible easel 52. The easel 52 preferably has a central fold line 54, so that the easel can fold flat when not in use. The easel 52 also has two notches 56 for engaging one of the edges of the holder 20, and two sloped side edges 58 and 60 for supporting the back of the holder, so that the easel supports the sign holder in a generally upright position. The easel 52 can support the holder on the orientation shown in FIG. 7, with the holder indicating a generally forward direction, or the holder can be supported by the easel in an orientation indicating a generally left or right direction. The easel 52 can be releasably attached to the back of the holder 20 for convenient storage when the easel is not in use.

Figure 3:
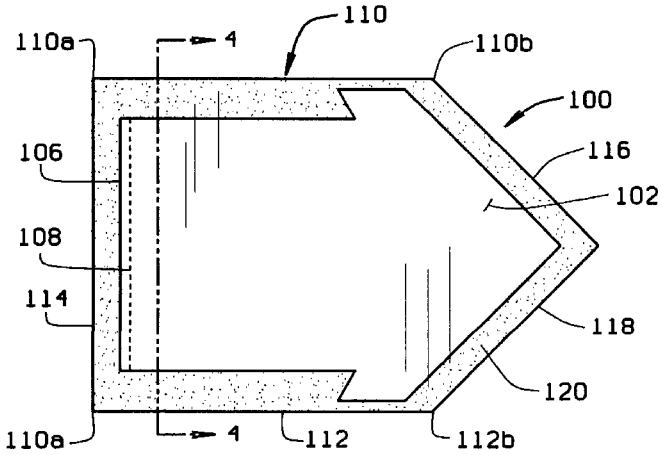
FIG. 3 is a top plan view of a second embodiment of a direction-indicating sign holder constructed according to the principles of this invention.
Figure 4:
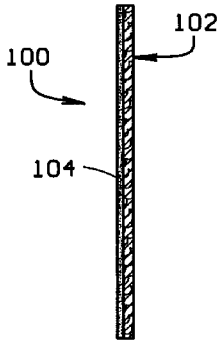
FIG. 4 is a transverse cross-sectional view, taken along the plane of line 4—4 in FIG. 3, of the sign holder of the second embodiment.

A second embodiment of a direction-indicating sign holder constructed according to the principles of this invention is indicated generally as 100 in FIGS. 3 and 4. The second embodiment is substantially similar to the holder 20. The holder 100 is generally flat, comprising a top panel 102 and a bottom panel 104 secured together to form a sign-receiving envelope 106 between the panels. The top panel 102 is preferably transparent, and is preferably a flexible sheet of transparent vinyl, or other suitable material. The bottom panel 104 is not transparent, and is preferably a flexible sheet of vinyl or other suitable material. The top panel 102 and the bottom panel 104 are preferably secured together at their respective side edges by heat welding, adhesives, or other suitable means. The bottom panel 104 preferably has a slip-resistant surface so that the holder can be placed on the ground, if desired, and not readily slide around.

The envelope 106 has a opening therein so that a sign 22 can be placed into the envelope and removed from the envelope. The opening can comprise a slit in one of the panels, such as transversely extending slit 108 in the bottom panel 104. Alternatively, the opening can comprise a gap between the top and bottom panels.

The holder 100 is shaped to have two converging side edges that indicate a direction, such that the holder can be oriented with the converging side edges indicating a direction. The holder 100 preferably has a pentagonal shape similar to the shape of holder 20, comprising first and second elongate, parallel sides 110 and 112, having corresponding first and second ends 110*a* and 112*a*, and 110*b* and 112*b*, respectively. A third side 114, extending generally perpendicular to the first and second sides 110 and 112, connects the first ends 110*a* and 112*a* of the first and second sides. Converging third and fourth sides 116 and 118 connect the second ends 110*b* and 112*b* of the first and second sides 110 and 112. In this preferred embodiment, each of the top and bottom panels 102 and 104 have a similar irregular pentagonal shape corresponding to the shape of holder 100.

The holder 100 may also include a direction-indicating graphic 120 on one of the panels. This graphic may be printed onto either the top surface of the top panel, or because the top panel is transparent it may also be printed on the underside surface of the top panel, or the top surface of the bottom panel. As shown in FIG. 3, the graphic 120 preferably comprises a contrasting border having an outside edge generally corresponding to the shape of the holder 100, in this preferred embodiment an irregular pentagon. The inside edge of the graphic 120 forms the outline of an arrow pointing in the same direction as the converging side edges of the holder 100. Thus the graphic 120 enhances the direction-indicating capability of the holder 100.

The holder 100 may also comprise a plurality of mounting holes similar to holes 50 in holder 20.

Figure 5:
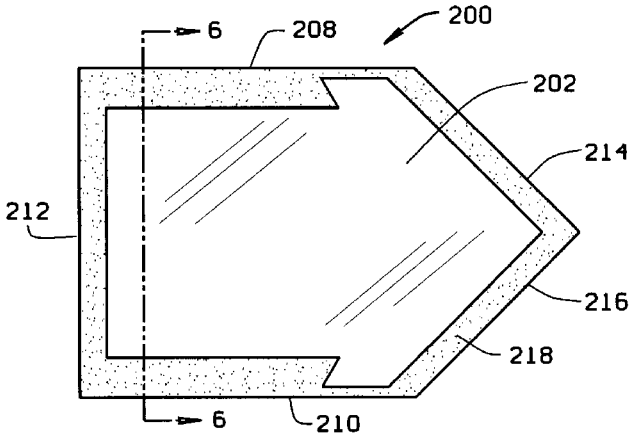
FIG. 5 is a top plan view of a third embodiment of a direction-indicating sign holder constructed according to the principles of this invention.
Figure 6:
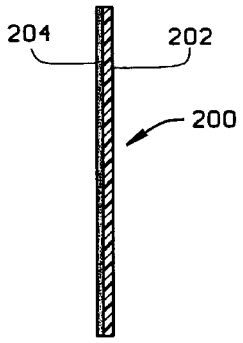
FIG. 6 is a transverse cross-sectional view, taken along the plane of line 6—6 in FIG. 5, of the sign holder of the third embodiment.

A third embodiment of a direction-indicating sign holder is indicated generally as 200 in FIGS. 5 and 6. The holder 200 is adapted for mounting an informational sign 22 on a surface such as a wall or floor. The sign holder 200 comprises a flat, flexible panel 202. The side edge margins of the underside of the panel having an adhesive thereon for removably securing the panel 202 over an informational sign 22 onto a surface. There is preferably a removable, protective backing 204 for protecting the adhesive until the backing is removed to use the holder. At least the center portion 206 of the panel is transparent so that information on a sign under the panel 202 is visible therethrough.

The panel 202 has a shape with two converging side edges that indicate a direction, such that the holder can be oriented with the converging side edges indicating a direction. As shown in FIG. 5, the holder 200 preferably has a pentagonal shape similar to the shape of holders 20 and 100, comprising first and second elongate, parallel sides 208 and 210, having corresponding first and second ends 208*a* and 210*a*, and 208*b* and 210*b*, respectively. A third side 212, extending generally perpendicular to the first and second sides 208 and 210, connects the first ends 208*a* and 210*a* of the first and second sides. Converging third and fourth sides 214 and 216 connect the second ends 208*b* and 210*b* of the first and second sides 208 and 210.

The holder 200 may also include a direction-indicating graphic 218 on one of the panels. This graphic may be printed onto either the top surface of the top panel, or because the top panel is transparent it may also be printed on the underside surface of the top panel, or the top surface of the bottom panel. As shown in FIG. 5, the graphic 218 preferably comprises a contrasting border having an outside edge generally corresponding to the shape of the holder 200, in this preferred embodiment an irregular pentagon. The inside edge of the graphic 218 forms the outline of an arrow pointing in the same direction as the converging side edges of the holder 100. Thus the graphic 120 enhances the direction-indicating capability of the holder 100.

Figure 8:
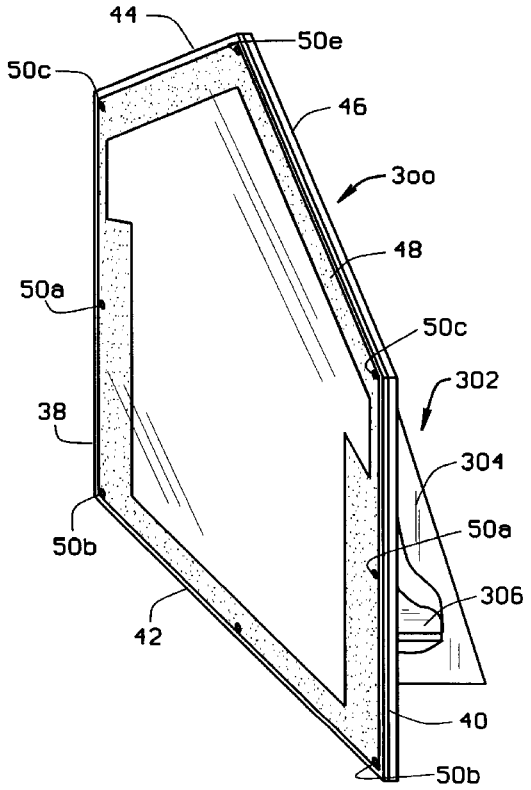
FIG. 8 is a perspective view of a fourth embodiment of a direction-indicating sign holder constructed according to the principles of this invention, incorporating a self-supporting easel.

A fourth embodiment of a direction-indicating sign holder is indicated generally as 300 in FIG. 8. Sign holder 300 is similar in construction to sign holder 20, and corresponding parts are identified with corresponding reference numerals. However, sign holder 300 also includes an integral easel-stand 302. The easel stand 302 is of conventional construction comprising first and second interlocking leaves 304 and 306 that fold out on mutually perpendicular fold lines to releasably interlock and form a stand for supporting the sign holder.

The method of this invention provides directional information associated with an informational sign. The method comprises the steps of providing an informational sign; providing a direction-indicating sign holder for indicating a direction associated with information on the sign; inserting the informational sign into the envelope holder; and orienting the sign holder to indicate a direction toward a location associated with information on the sign in the envelope.

OPERATION

In operation, an informational sign 22 is placed in the envelope 28 of the direction-indicating sign holder 20 of the first embodiment, through the opening. The information on the sign is clearly visible through the top panel 24. The informational sign 22 might contain information about an event, such as a conference, a class, a performance, etc. being held at a specific time and place. The holder 20 is then oriented so that the converging sides 44 and 46 point in a direction toward a location associated with the information on the sign 22. The holder 22 protects the sign 22, and provides a conspicuous yet professional-looking directional signal, directing persons to the location associated with the information on the sign.

The holder 20 can be laid on the floor, hung on a wall or stand by one of the mounting holes 50, or supported on a table or the floor with an integral easel or a separate stand. Thus the holder can be placed where it is readily visible, to maximize its direction-indicating function. The holder 20 can also be mounted on the easel 52, by folding the easel 52 along fold line 54 and inserting one of the side edges of the holder into notches 56.

In operation, an information sign 22 is placed in the envelope 106 of the direction-indicating sign holder 100 of the second embodiment, through the slit 108 in the bottom panel 104. The informational sign is clearly visible through the top panel 102. The holder 100 is then oriented so that the converging sides 116 and 118 point in a direction toward a location associated with the information on the sign 22. The holder 100 protects the sign 22, and provides a conspicuous yet professional-looking directional signal, directing persons to the location associated with the information on the sign.

The holder 100 can be laid on the floor, hung on a wall or stand by one of the mounting holes, or supported on a table or the floor with an integral easel or a separate stand. Thus the holder can be placed where it readily visible, to maximize its direction-indicating function.

In operation, an informational sign 22 is placed under the panel 202 of the direction-indicating sign holder 200 of the second embodiment. The informational sign is clearly visible through the center portion of the panel 202. The holder 200 is then oriented so that the converging sides 214 and 216 point in a direction toward a location associated with the information on the sign 22. The holder 200 is secured by removing the protective backing 204, and securing the panel 202 in the desired location. The holder 200 protects the sign 22, and provides a conspicuous yet professional-looking directional signal, directing persons to the location associated with the information on the sign.

The holder 200 can be secured to the floor or hung on a wall. Thus the holder can be placed where it readily visible, to maximize its direction-indicating function.

In operation, an informational sign 22 is placed in the envelope 28 of the direction-indicating sign holder 300. The sign holder can be used and displayed exactly like holder 20, as described above. However, in addition, the integral easel stand can be erected to make the holder 300 self-supporting. Leaves 304 and 306 are folded out and releasably interlocked to erect the easel stand to support the sign holder 300.

Thus, the direction-indicating sign holders of the present invention provide a simple easy to use way of protecting an informational sign, and positioning the sign in a manner and location that the sign is conspicuous, easy to read, and provides directional information to assist people in finding a location associated with the information on the sign.

What is claimed is:

1. A direction-indicating holder for an informational sign for use in directing people to a location associated with information on the sign, the holder comprising:

top and bottom panels secured together to form a sign-receiving envelope between the panels, at least the top panel being transparent so that information on a sign in the envelope is visible, the envelope having an opening therein for introducing and removing a sign from the envelope, the holder having a shape with two converging side edges that indicate a direction, such that the holder can be oriented with the converging side edges indicating a direction toward a location associated with the information on a sign in the envelope.

2. The holder according to claim 1 further comprising a direction-indicating graphic on one of the panels, the graphic comprising a contrasting border having an outside edge corresponding to the shape of the holder, and an inside edge forming an arrow pointing in the same direction as the converging side edges of the holder.

3. The holder according to claim 1 wherein the top and bottom panels are similar, irregular pentagons, each having first and second elongate parallel sides with corresponding first and second ends; a third side connecting the first ends of the first and second sides; and converging third and fourth sides connecting the second ends of the first and second sides.

4. The holder according to claim 1 wherein the top and bottom panels are joined adjacent their respective side edges.

5. The holder according to claim 4 wherein the opening is formed by a gap between the side edges of the top and bottom panels.

6. The holder according to claim 1 wherein the opening is formed by a slit in one of the top and bottom panels.

7. The combination according to claim 1 comprises further comprising a support for supporting the holder in a generally upright orientation.

8. A direction-indicating holder for an informational sign for use in directing people to a location associated with information on the sign, the holder comprising:

top and bottom panels secured together generally adjacent their side edges to form an envelope between the panels, into which a sign can be placed, the top panel being transparent so that information on a sign in the envelope is visible, the top and the bottom panels being similarly shaped, irregular pentagons having first and second elongate parallel sides with corresponding first and second ends, a third side connecting the first ends of the first and second sides, and converging fourth and fifth sides connecting the second ends of the first and second sides, the converging sides indicating a direction such that the holder can be oriented with the converging side edges indicating a direction toward a location associated with information on a sign in the envelope;

a direction-indicating graphic on one of the panels, the graphic comprising a contrasting border having an outer edge corresponding to the pentagonal shape of the panels, and an inner edge forming an arrow pointing the same direction as the converging sides of the panels; and an opening in the holder for introducing and removing a sign from the envelope.

9. The holder according to claim 8 wherein the opening is formed by a gap between the side edges of the top and bottom panels.

10. The holder according to claim 8 wherein the opening is formed by a slit in one of the top and bottom panels.

11. The holder according to claim 8 further comprising a fold-out easel on the back panel which can be assembled to support the holder generally upright.

12. In combination with an informational sign, a direction-indicating holder for use in directing people to a location associated with information on the sign, the holder comprising:

top and bottom panels secured together to form a sign-receiving envelope between the panels, at least the top panel being transparent so that information on a sign in the envelope is visible, the envelope having an opening therein for introducing and removing a sign from the envelope, the holder having a shape with two converging side edges that indicate a direction, such that the holder can be oriented with the converging side edges indicating a direction toward a location associated with the information on a sign in the envelope.

13. The combination according to claim 12 wherein the holder further comprises a direction-indicating graphic on one of the panels, the graphic comprising a contrasting border having an outside edge corresponding to the shape of the holder, and an inside edge forming an arrow pointing in the same direction as the converging side edges of the holder.

14. The combination according to claim 12 wherein the top and bottom panels of the holder are similar, irregular pentagons, each having first and second elongate parallel sides with corresponding first and second ends; a third side connecting the first ends of the first and second sides; and converging third and fourth sides connecting the second ends of the first and second sides.

15. The combination according to claim 12 wherein the top and bottom panels of the holder are joined adjacent their respective side edges.

16. The combination according to claim 15 wherein the opening in the holder is formed by a gap between the side edges of the top and bottom panels.

17. The combination according to claim 12 wherein the opening in the holder is formed by a slit in one of the top and bottom panels.

18. A method of providing a directional indication to people, the method comprising the steps of:

providing an informational sign;

providing a direction-indicating sign holder for indicating a direction associated with information on the sign, the holder comprising: top and bottom panels secured together to form a sign-receiving envelope between the panels, at least the top panel being transparent so that information on a sign in the envelope is visible, the envelope having an opening therein for introducing and removing a sign from the envelope, the holder having a shape with two converging side edges that indicate a direction, such that the holder can be oriented with the converging side edges indicating a direction toward a location associated with the information on a sign in the envelope;

inserting the informational sign into the envelope holder; and orienting the sign holder to indicate a direction toward a location associated with information on the sign in the envelope.

* * * * *